US009771248B1

(12) United States Patent
Zimmerman

(10) Patent No.: US 9,771,248 B1
(45) Date of Patent: Sep. 26, 2017

(54) STABILIZED JACK ASSEMBLY

(71) Applicant: Mark Lee Zimmerman, Hilliard, OH (US)

(72) Inventor: Mark Lee Zimmerman, Hilliard, OH (US)

( * ) Notice: Subject to any disclaimer, the term of this patent is extended or adjusted under 35 U.S.C. 154(b) by 0 days.

(21) Appl. No.: 15/199,094

(22) Filed: Jun. 30, 2016

(51) Int. Cl.
*B66F 3/12* (2006.01)
*B66F 13/00* (2006.01)

(52) U.S. Cl.
CPC ..... *B66F 3/12* (2013.01); *B66F 13/00* (2013.01)

(58) Field of Classification Search
CPC .. B66F 13/00; B66F 17/00; B66F 3/00; B66F 3/08; B66F 3/12; B66F 3/22; B66F 7/065; B66F 7/246; B66F 7/28
See application file for complete search history.

(56) References Cited

U.S. PATENT DOCUMENTS 2,075,398 A * 3/1937 Kunath ..... B66F 3/16 248/188.91
2,924,463 A * 2/1960 Livermont ..... B60D 1/345 248/351
3,232,584 A * 2/1966 Miles ..... B66F 13/00 248/166
3,314,655 A * 4/1967 Steele ..... B66F 3/10 254/102
3,475,008 A * 10/1969 Taylor ..... B60S 9/06 254/424
3,834,548 A * 9/1974 Cliffton ..... A47G 25/54 211/118
4,014,517 A * 3/1977 Keagle ..... B66F 13/00 248/157
4,718,519 A * 1/1988 Barker ..... B66F 3/22 187/211
5,261,644 A * 11/1993 Armstrong ..... B66F 3/12 254/126
6,331,016 B1 * 12/2001 Wallace ..... B60S 9/06 254/424
7,073,763 B1 * 7/2006 Trout ..... B66F 3/12 248/188.8
7,188,842 B2 * 3/2007 Thorpe ..... B60S 9/06 280/6.153
7,338,052 B2 * 3/2008 Hanscom ..... B60P 3/36 14/71.3
2007/0284499 A1 * 12/2007 Hammac ..... B60P 3/36 248/346.01
2009/0200527 A1 * 8/2009 Christie ..... B66F 3/12 254/122

* cited by examiner

*Primary Examiner* — Larry E Waggle, Jr.
*Assistant Examiner* — Tyrone V Hall, Jr.

(57) ABSTRACT

A stabilized jack assembly is a device utilized to elevate and stabilize a vehicle. The device eliminates the need for the user to venture beneath the vehicle before the vehicle is stabilized. The device includes a planar base that provides stability for the device on a flat surface. A scissor lift assembly is utilized to elevate and lower a mounting head that is placed into contact with the vehicle. A threaded spindle is axially engaged through the scissor lift assembly and is rotated in order to elevate and lower the mounting head. A plurality of support struts is utilized to stabilize the device once the vehicle is elevated. The plurality of support struts is removably engaged into a plurality of strut braces on the planar base. The plurality of support struts is able to automatically engage the plurality of strut braces when the vehicle has been sufficiently elevated.

12 Claims, 9 Drawing Sheets

SECTION A-A

STABILIZED JACK ASSEMBLY

FIELD OF THE INVENTION

The present invention relates generally to a jack for elevating a vehicle. More specifically, the present invention is a stabilized jack assembly that allows the user to quickly elevate and stabilize a vehicle before moving beneath and performing work underneath the vehicle.

BACKGROUND OF THE INVENTION

It is often necessary to elevate a vehicle for various reasons ranging from replacing a tire to routine maintenance. This is typically done by utilizing a jack to slowly elevate the vehicle until sufficient room to perform work is present below the vehicle. A jack stand is then utilized to stabilize and hold the vehicle in place in the lifted position as the jack alone is unstable, leading to danger for the person performing work underneath the vehicle. Virtually all vehicles are manufactured with engineered jacking points that are the most structurally stable positions from which to elevate the vehicles. When utilizing a conventional jack and a separate jack stand, the vehicle is first lifted utilizing the jack and then the jack stand is placed into a secure position near the jack. However, once a jacking point has been utilized to lift the vehicle, the jacking point is unavailable when inserting the jack stand to stabilize the vehicle. Because the jack stand placement is by default left to the discretion of the user once the engineered jacking point is occupied by the jack, the jack stand may be poorly positioned to provide stability for the vehicle. The person is additionally forced to move underneath an unstable vehicle in order to identify a "safe and secure" position to place the jack stand. This must be done three additional times if the person wishes to elevate the entire vehicle.

The present invention is a stabilized jack assembly that is utilized to both elevate and stabilize a vehicle before the user moves underneath the vehicle. The present invention serves as a single device that is utilized to perform both the elevation and the stabilization of the vehicle. This eliminates the step of moving underneath and stabilizing the vehicle once the vehicle is elevated, allowing the user to avoid a potentially dangerous situation.

DETAIL DESCRIPTIONS OF THE INVENTION

All illustrations of the drawings are for the purpose of describing selected versions of the present invention and are not intended to limit the scope of the present invention.

Figure 1:
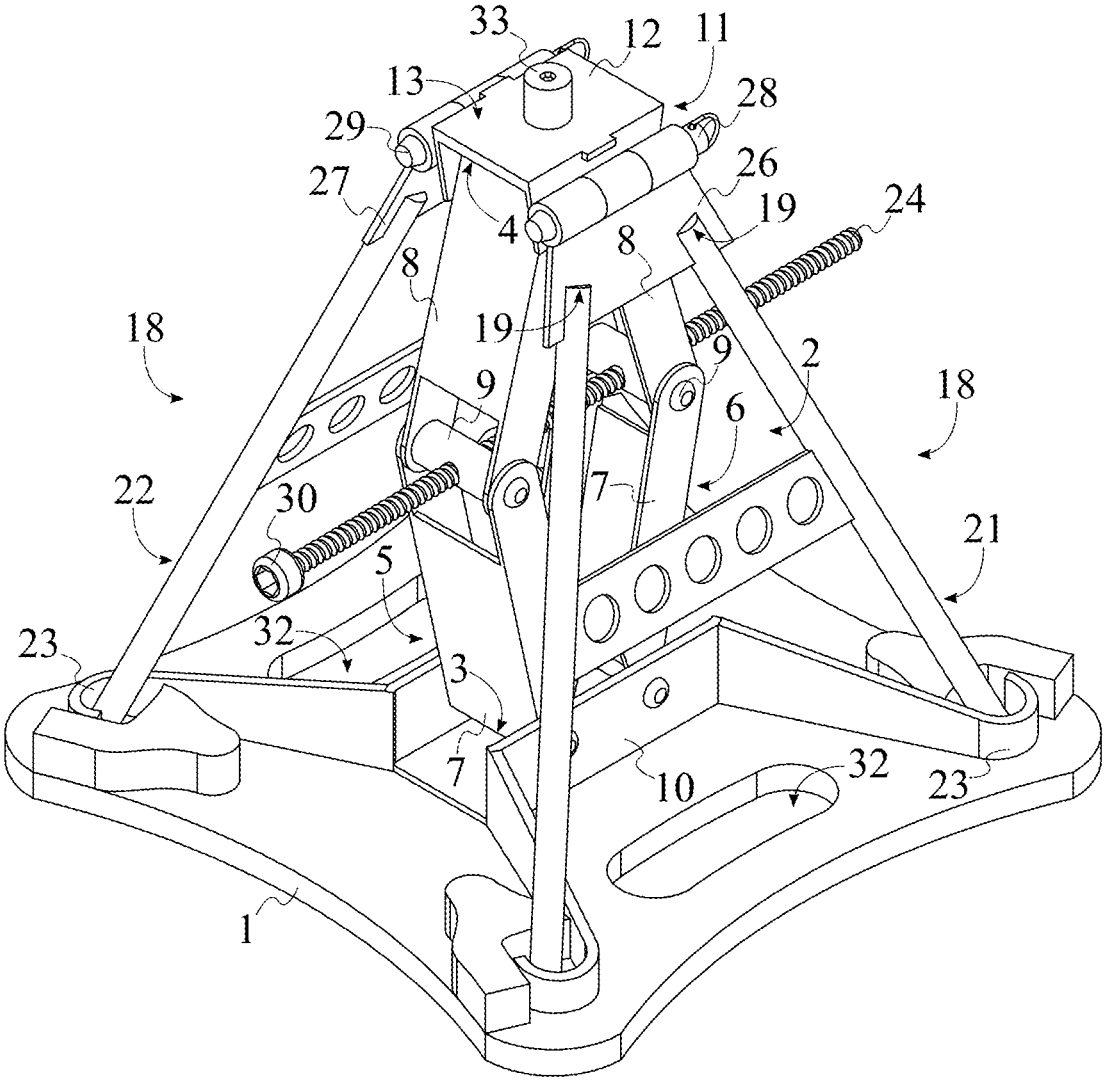
FIG. 1 is a perspective view of the present invention.
Figure 2:
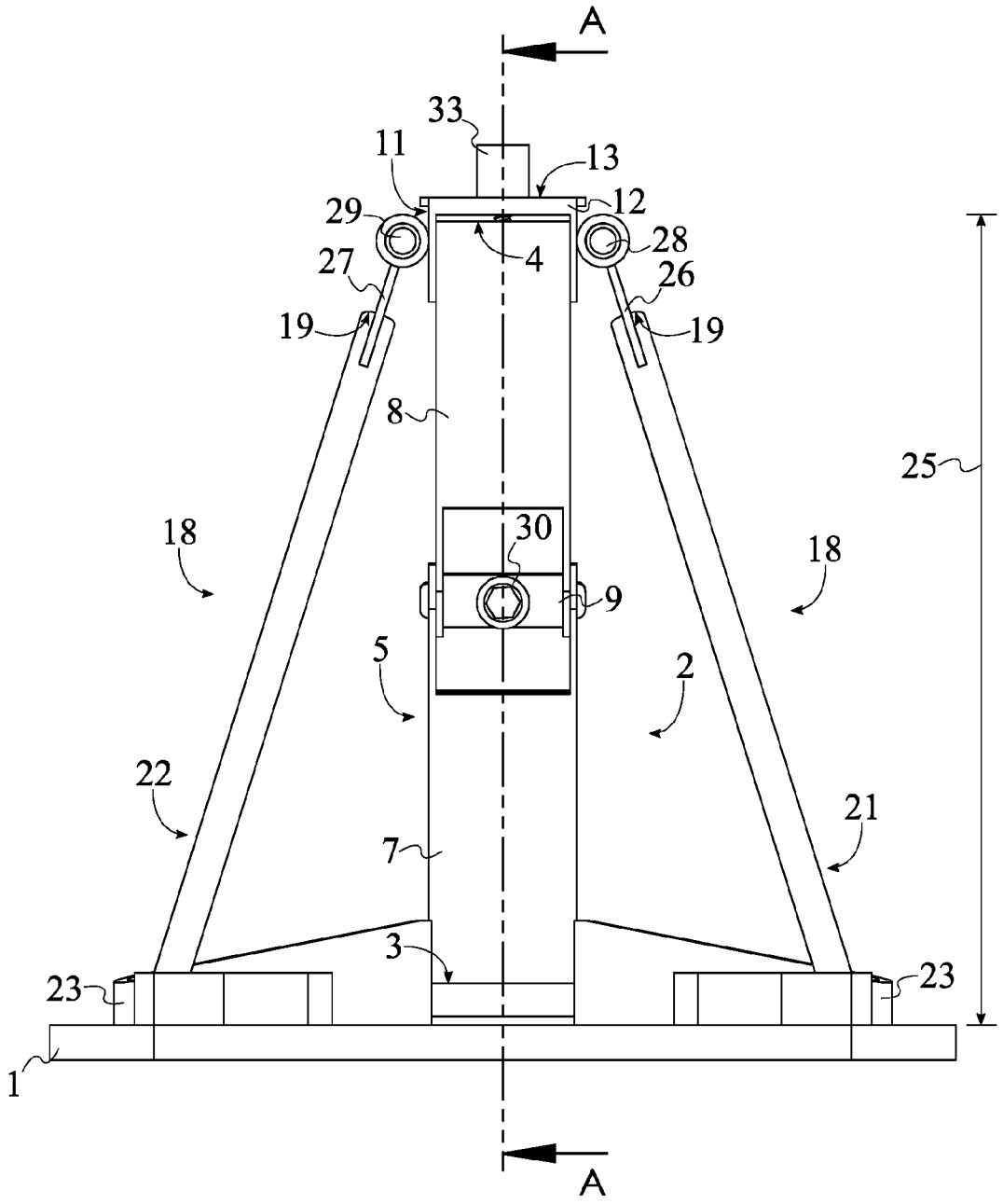
FIG. 2 is a side view of the present invention.
Figure 3:
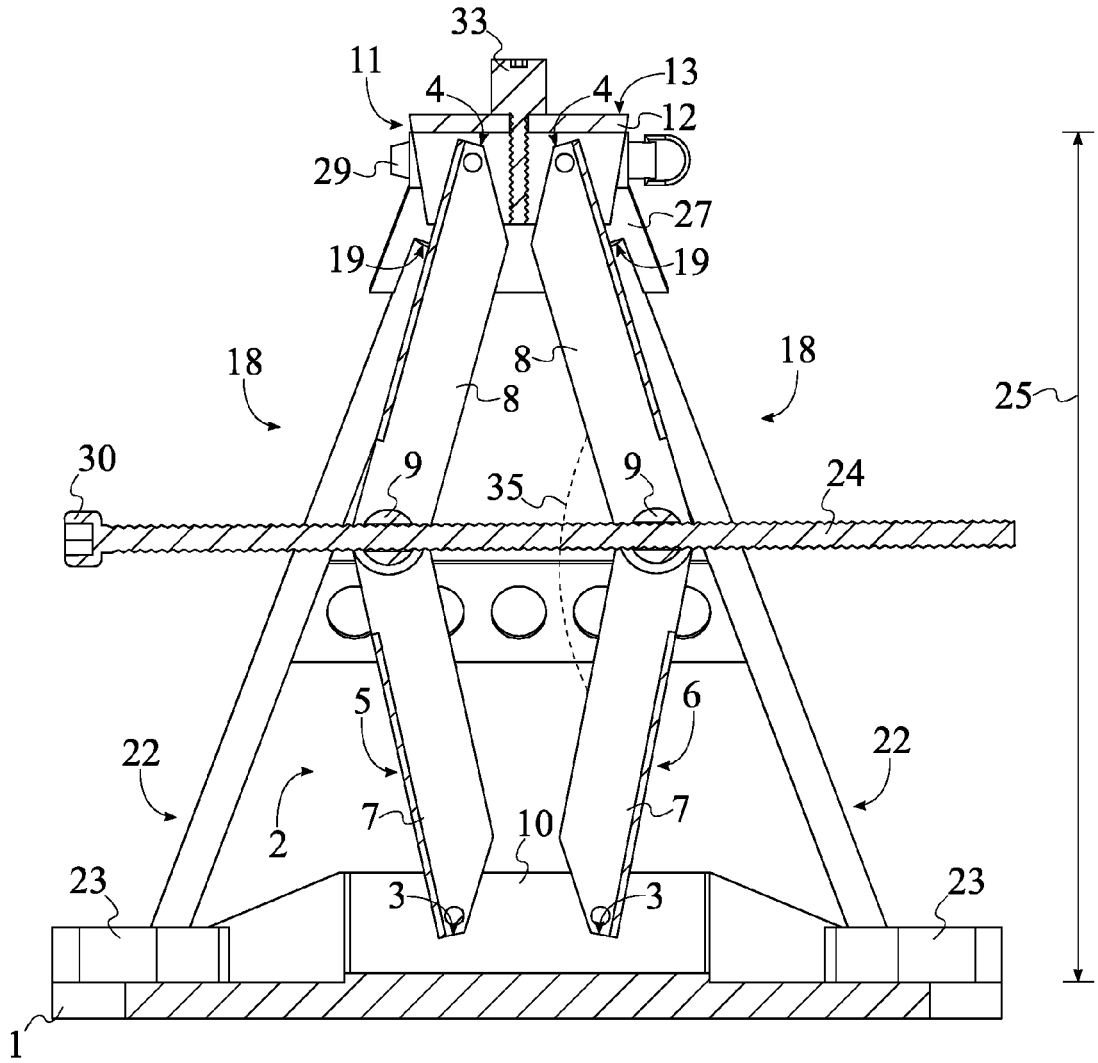
FIG. 3 is a cross-sectional view of the present invention taken along line A-A of FIG. 2.
Figure 4:
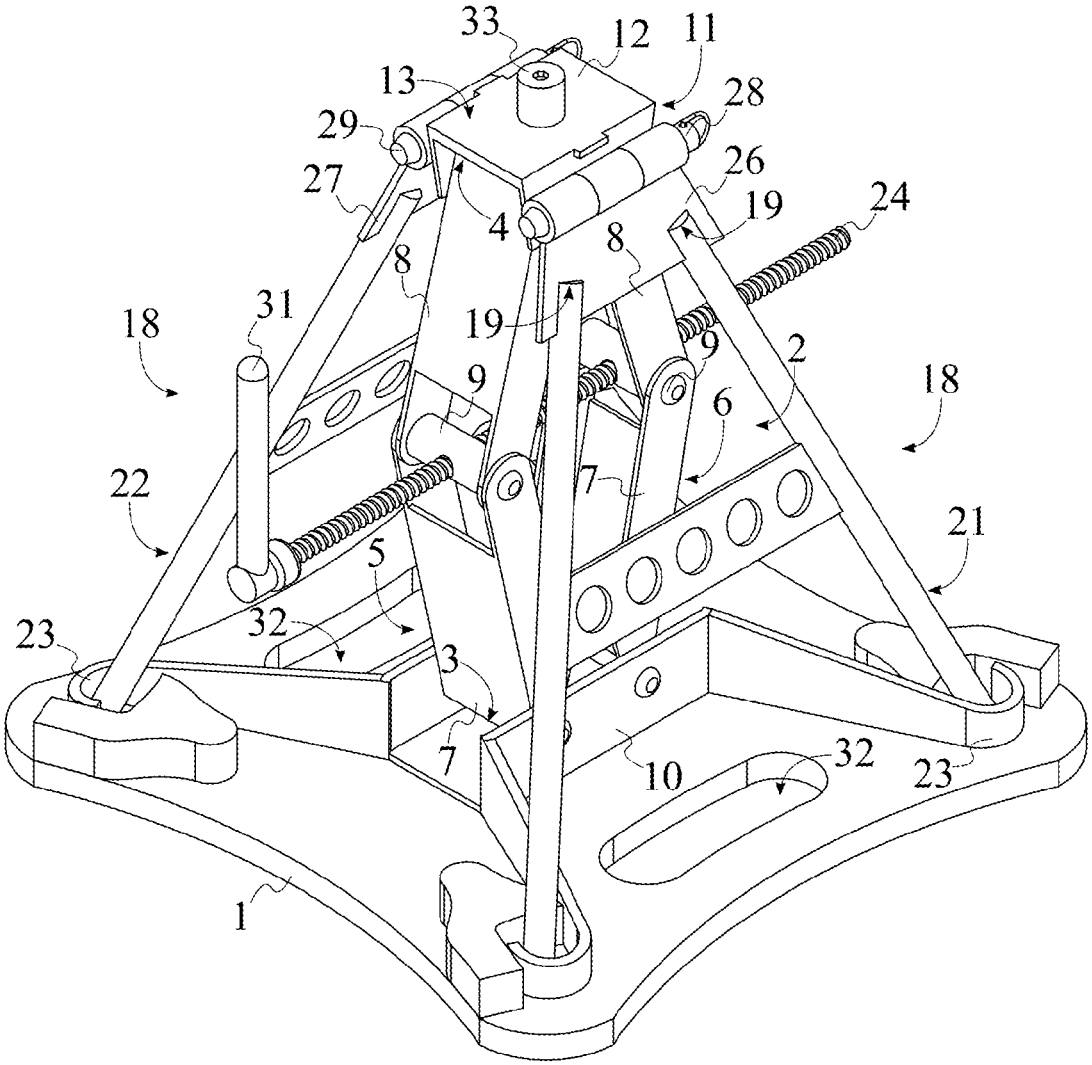
FIG. 4 is a perspective view of an embodiment of the present invention with leveraging handle.

The present invention is a stabilized jack assembly that is utilized to elevate and stabilize a vehicle without requiring the user to venture beneath the vehicle until the vehicle has been stabilized. The preferred embodiment of the present invention is shown in FIGS. 1-3 while an alternative embodiment of the present invention is shown in FIG. 4. The present invention comprises a planar base 1, a mounting bracket 10, a scissor lift assembly 2, a mounting head 11, a plurality of support struts 18, a plurality of strut braces 23, and a threaded spindle 24. The present invention is shown in a lowered position in FIG. 5 and FIG. 6.

The planar base 1 serves as a stable foundation for the present invention and is placed onto a surface such as the ground when the present invention is in use. The mounting bracket 10 is utilized to secure the scissor lift assembly 2 to the planar base 1. The mounting bracket 10 is centrally fixed on the planar base 1 in order to allow the planar base 1 to provide maximum stability to the scissor lift assembly 2 when the present invention is in use. The mounting bracket 10 may be independent of the planar base 1 or integrated with the planar base 1 for further stability of the present invention. The scissor lift assembly 2 is utilized to elevate or lower a vehicle. A first end 3 of the scissor lift assembly 2 is hingedly connected to the mounting bracket 10. The scissor lift assembly 2 may thus be hingedly repositioned and reoriented relative to the mounting bracket 10 as the scissor lift assembly 2 is raised or lowered.

The mounting head 11 is the component that is placed into contact with the vehicle while the vehicle is elevated or lowered. The mounting head 11 is hingedly connected to a second end 4 of the scissor lift assembly 2. As a result, the scissor lift assembly 2 is able to hingedly reposition and reorient relative to the mounting head 11 while the scissor lift assembly 2 is raised or lowered. The mounting head 11 is offset from the planar base 1 by an adjustable distance 25. The adjustable distance 25 changes as the vehicle is elevated or lowered and may vary based on the individual height requirement for elevating the vehicle.

The plurality of support struts 18 is utilized to stabilize the present invention and the vehicle once the vehicle is elevated. The plurality of strut braces 23 is utilized to secure the plurality of support struts 18 in place in order to stabilize the present invention and the vehicle after the vehicle has been elevated to the desired height. An upper end 19 of each of the plurality of support struts 18 is hingedly and removably connected to the mounting head 11. The plurality of support struts 18 is thus able to hinge relative to the mounting head 11 as the vehicle is elevated. In the preferred embodiment of the present invention, the hinged connection between the plurality of support struts 18 and the mounting head 11 enables the plurality of support struts 18 to automatically engage the plurality of strut braces 23 once the vehicle has been sufficiently elevated. The plurality of support struts 18 is removable from the mounting head 11 when the present invention is not in use. The plurality of strut braces 23 is distributed about the planar base 1, allowing the plurality of strut braces 23 to evenly and sufficiently stabilize the present invention. In the preferred embodiment of the present invention, the plurality of strut braces 23 is positioned in the four corners of the planar base 1 to provide maximum stability to the present invention. A lower end 20 of each of the plurality of support struts 18 is removably engaged into a corresponding brace from the plurality of strut braces 23. Once engaged into the corresponding brace, the lower end 20 of each of the plurality support struts is fixed in place in order to prevent the present invention from shifting or otherwise moving.

The threaded spindle 24 is utilized in conjunction with the scissor lift assembly 2 in order to elevate or lower the vehicle. The threaded spindle 24 is axially engaged through the scissor lift assembly 2. In order to elevate the vehicle, the user is required to provide rotational force to the threaded spindle 24. The vehicle may be lowered by rotating the threaded spindle 24 in the opposite direction. The threaded spindle 24 engages the scissor lift assembly 2 in order to translate the rotational force of the threaded spindle 24 to vertical elevation or lowering of the mounting head 11. The threaded spindle 24 may include a stopper for preventing the threaded spindle 24 from separating from the scissor lift assembly 2.

In the preferred embodiment of the present invention, the scissor lift assembly 2 further comprises a first pair of arms 5 and a second pair of arms 6. The first pair of arms 5 and the second pair of arms 6 are utilized to hingedly elevate and lower the mounting head 11. The first pair of arms 5 and the second pair of arms 6 are positioned adjacent to each other on the mounting bracket 10, allowing the first pair of arms 5 and the second pair of arms 6 to be positioned and oriented relative to each other as the vehicle is elevated or lowered. The first pair of arms 5 and the second pair of arms 6 each comprise a lower arm 7, an upper arm 8, and a joint 9. The lower arm 7 is positioned toward the planar base 1 and the mounting bracket 10 while the upper arm 8 is positioned toward the mounting head 11. The joint 9 serves as a connection point between the lower arm 7 and the upper arm 8.

The lower arm 7 is hingedly connected to the mounting bracket 10 and as such is able to pivot about the mounting bracket 10 as the vehicle is elevated or lowered. The upper arm 8 is hingedly connected to the lower arm 7 by the joint 9, opposite to the mounting bracket 10. The joint 9 provides the hinged scissor-like expansion or contraction movement between the lower arm 7 and the upper arm 8 that serves to elevate and lower the mounting head 11. The mounting head 11 is hingedly connected to the upper arm 8, opposite to the lower arm 7. The mounting head 11 is thus able to remain oriented parallel to the planar base 1 for stability of the present invention as the vehicle is elevated or lowered. The threaded spindle 24 is axially engaged through the joint 9 of the first pair of arms 5 and the joint 9 of the second pair of arms 6. As a result, the rotation of the threaded spindle 24 is able to simultaneously move both the first pair of arms 5 and the second pair of arms 6 to elevate or lower the vehicle.

The present invention further comprises a first mounting plate 26 and a second mounting plate 27. Additionally, the plurality of support struts 18 further comprises a first pair of support struts 21 and a second pair of support struts 22. The first mounting plate 26 and the second mounting plate 27 are utilized to respectively connect the first pair of support struts 21 and the second pair of support struts 22 to the mounting head 11. The first mounting plate 26 is connected to the upper end 19 of the first pair of support struts 21 while the second mounting plate 27 is connected to the upper end 19 of the second pair of support struts 22. As a result, the first mounting plate 26 and the second mounting plate 27 are able to connect the upper end 19 of the first pair of support struts 21 and the upper end 19 of the second pair of support struts 22 to the mounting head 11. The first pair of support struts 21 is hingedly connected to the mounting head 11 by the first mounting plate 26 while the second pair of support struts 22 is hingedly connected to the mounting head 11 by the second mounting plate 27, opposite to the first pair of support struts 21. The first pair of support struts 21 and the second pair of support struts 22 are thus oriented with respect to each other to provide stability for the scissor lift assembly 2 on the planar base 1. In the preferred embodiment of the present invention, the first pair of support struts 21 and the second pair of support struts 22 are positioned to provide stability on the four corners of the planar base 1 corresponding to the plurality of strut braces 23. As a result, the first pair of support struts 21 and the second pair of support struts 22 are able to provide a wide base of support for the present invention when the mounting head 11 is elevated by the scissor lift assembly 2.

Figure 7:
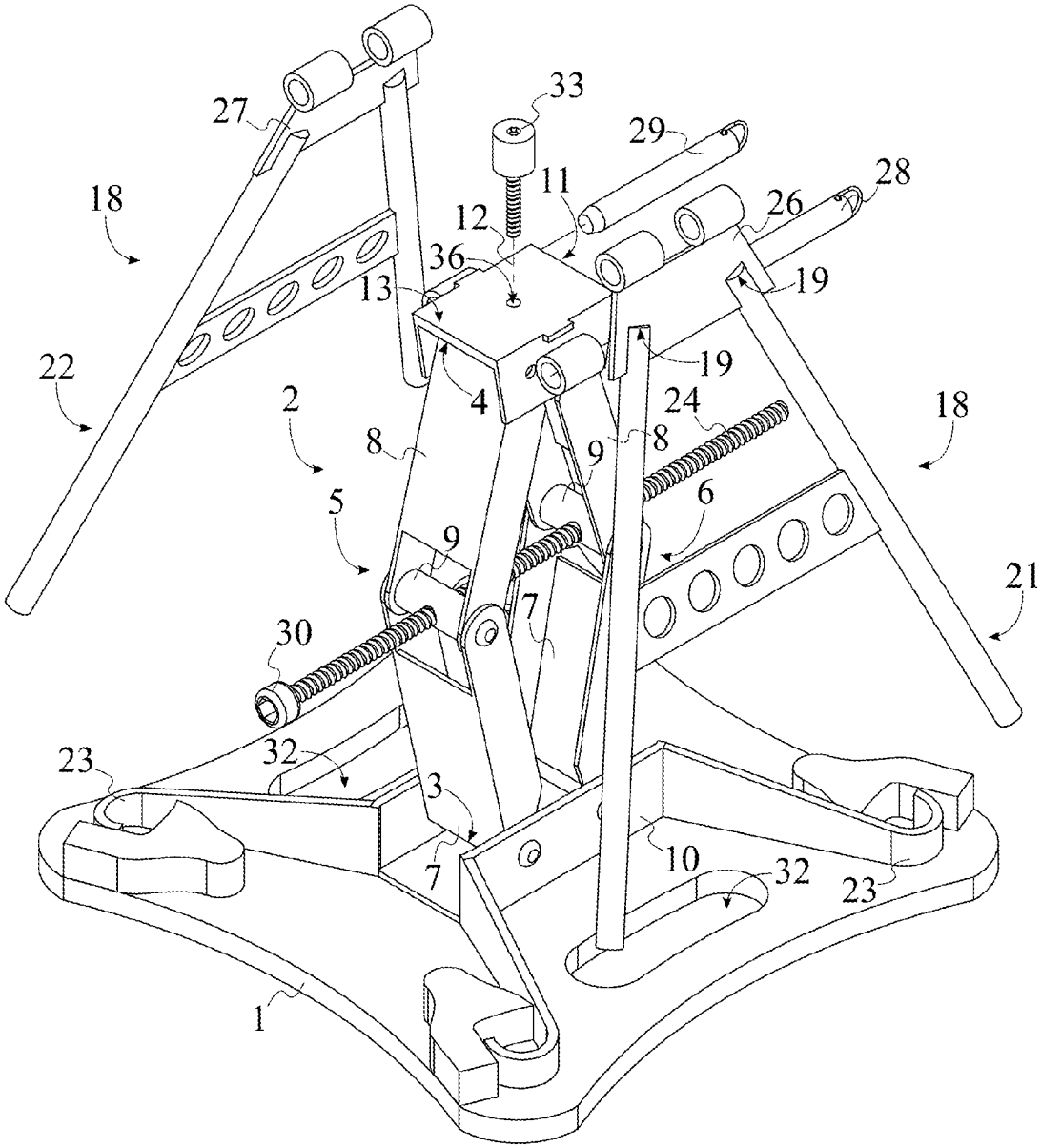
FIG. 7 is an exploded perspective view of the present invention.

The present invention further comprises a first quick-release pin 28 and a second quick-release pin 29 that are utilized to secure the first mounting plate 26 and the second mounting plate 27 to the mounting head 11. The first quick-release pin 28 and the second quick-release pin 29 additionally allow the first mounting plate 26 and the second mounting plate 27 to be easily separated from the mounting head 11 in order to remove the first pair of support struts 21 and the second pair of support struts 22 from the mounting head 11. As shown in FIG. 7, the first quick-release pin 28 is removably engaged to the mounting head 11 and the first mounting plate 26. The first quick-release pin 28 thus serves as a fastener for the mounting head 11 and the first mounting plate 26. Similarly, the second quick-release pin 29 is removably engaged to the mounting head 11 and the second mounting plate 27 with the second quick-release pin 29 serving as a fastener for the mounting head 11 and the second mounting plate 27. The first mounting plate 26 is hingedly connected to the mounting head 11 by the first quick-release pin 28, enabling the first mounting plate 26 and the first pair of support struts 21 to pivot about the mounting head 11. Similarly, the second mounting plate 27 is hingedly connected to the mounting head 11 by the second quick-release pin 29, enabling the second mounting plate 27 and the second pair of support struts 22 to pivot about the mounting head 11.

The embodiment of the present invention shown in FIGS. 1-3 further comprises an input socket 30 that is utilized to connect a means of providing a rotational force to the threaded spindle 24 in order to elevate or lower the vehicle. For example, the input socket 30 may be utilized to connect a power tool for providing rotational force to the threaded spindle 24. The input socket 30 is terminally connected to the threaded spindle 24, allowing the rotational force to be input through one end of the threaded spindle 24 while allowing the opposing end of the threaded spindle 24 to rotate freely. The threaded spindle 24 may additionally be rotated manually. The embodiment of the present invention shown in FIG. 4 further comprises a leveraging handle 31. The leveraging handle 31 may be grasped in order to physically rotate the threaded spindle 24 when elevating or lowering the vehicle.

With continued reference to FIGS. 1-3, the present invention further comprises at least one carrying slot 32. The at least one carrying slot 32 improves the portability of the present invention by providing a means to easily grasp and carry the present invention. The at least one carrying slot 32 traverses normally through the planar base 1, providing an opening in the planar base 1 through which the user may grasp the present invention.

The present invention may be utilized with various types of engineered jacking points found on vehicles. The embodiment of the present invention shown in FIGS. 1-3 is designed for use with a pin-style jacking point in which a rounded mounting slot is present underneath the vehicle. The embodiment of the present invention shown in FIGS. 1-3 further comprises a mounting pin 33. The mounting pin 33 is utilized to engage with a pin-style jacking point underneath the vehicle. Additionally, the mounting head 11 comprises a base plate 12 and a pin hole 36. The base plate 12 is a flat foundation for the mounting head 11 while the pin hole 36 is an opening that is able to accept the mounting pin 33. The pin hole 36 traverses normally through the base plate 12 in order to form an opening in the base plate 12. The mounting pin 33 is engaged into the pin hole 36 and is thus positioned in a manner such that the mounting pin 33 is able to engage the pin-style jacking point underneath the vehicle.

Figure 8:
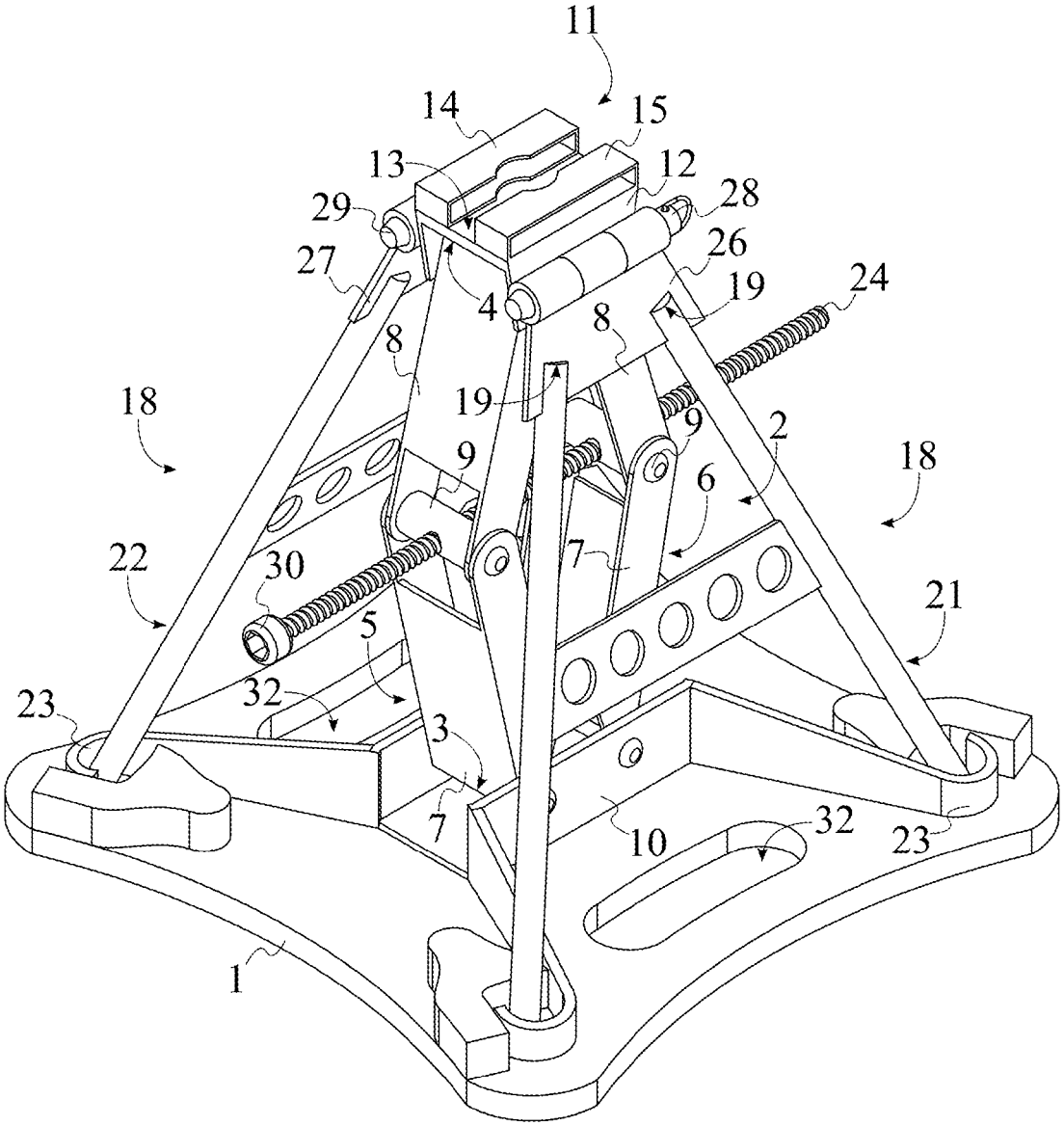
FIG. 8 is a perspective view of an embodiment of the present invention designed for use with a pinch weld style jacking point.

The embodiment of the present invention shown in FIG. 8 is designed for use with a pinch weld style jacking point. A pinch weld is an extruded crease underneath a vehicle that serves as a jacking point. In this embodiment of the present invention, the mounting head 11 comprises a first retaining lip 14 and a second retaining lip 15 that are able to engage a pinch weld. The first retaining lip 14 and the second retaining lip 15 are connected across an upper surface 13 of the base plate 12. The first retaining lip 14 and the second retaining lip 15 are thus positioned on the base plate 12 in a manner such that the pinch weld may be easily engaged by the first retaining lip 14 and the second retaining lip 15 when elevating the vehicle. The first retaining lip 14 and the second retaining lip 15 are offset from and oriented parallel to each other. As a result, a channel is formed in between the first retaining lip 14 and the second retaining lip 15 that is able to accept the pinch weld.

Figure 9:
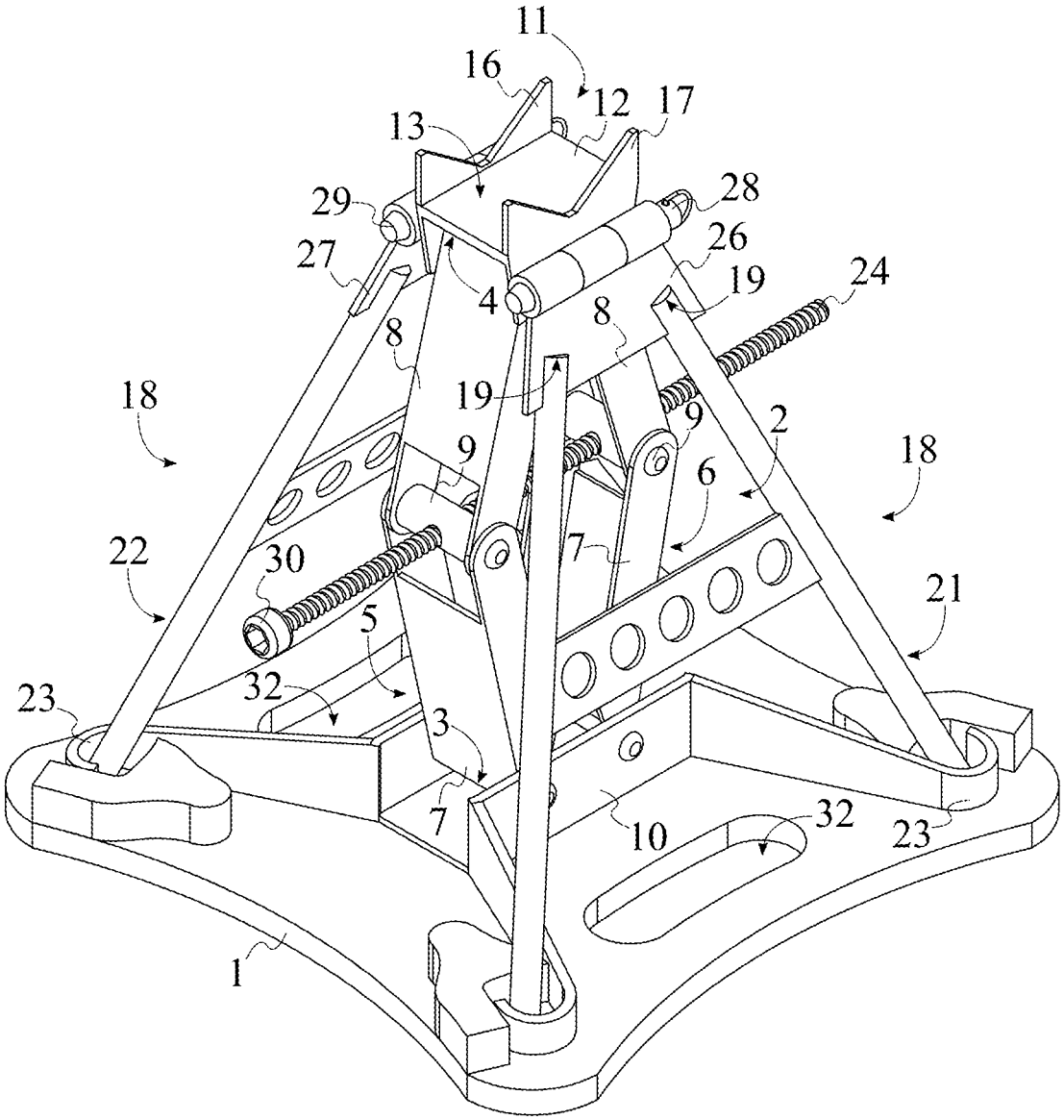
FIG. 9 is a perspective view of an embodiment of the present invention designed for use with a tube-style jacking point.

The embodiment of the present invention shown in FIG. 9 is designed for use with a tube-style jacking point. In this embodiment of the present invention, the mounting head 11 comprises a first V-shaped plate 16 and a second V-shaped plate 17. The first V-shaped plate 16 and the second V-shaped plate 17 are able to engage the tube-style jacking point underneath the vehicle by seating the tube into the first V-shaped plate 16 and the second V-shaped plate 17. The first V-shaped plate 16 and the second V-shaped plate 17 are connected normal to the upper surface 13, positioning the first V-shaped plate 16 and the second V-shaped plate 17 to seat the tube. The first V-shaped plate 16 and the second V-shaped plate 17 are offset from and oriented parallel to each other. Offsetting the first V-shaped plate 16 and the second V-shaped plate 17 from each other provides stability for the present invention when the tube is seated into first V-shaped plate 16 and the second V-shaped plate 17.

Figure 5:
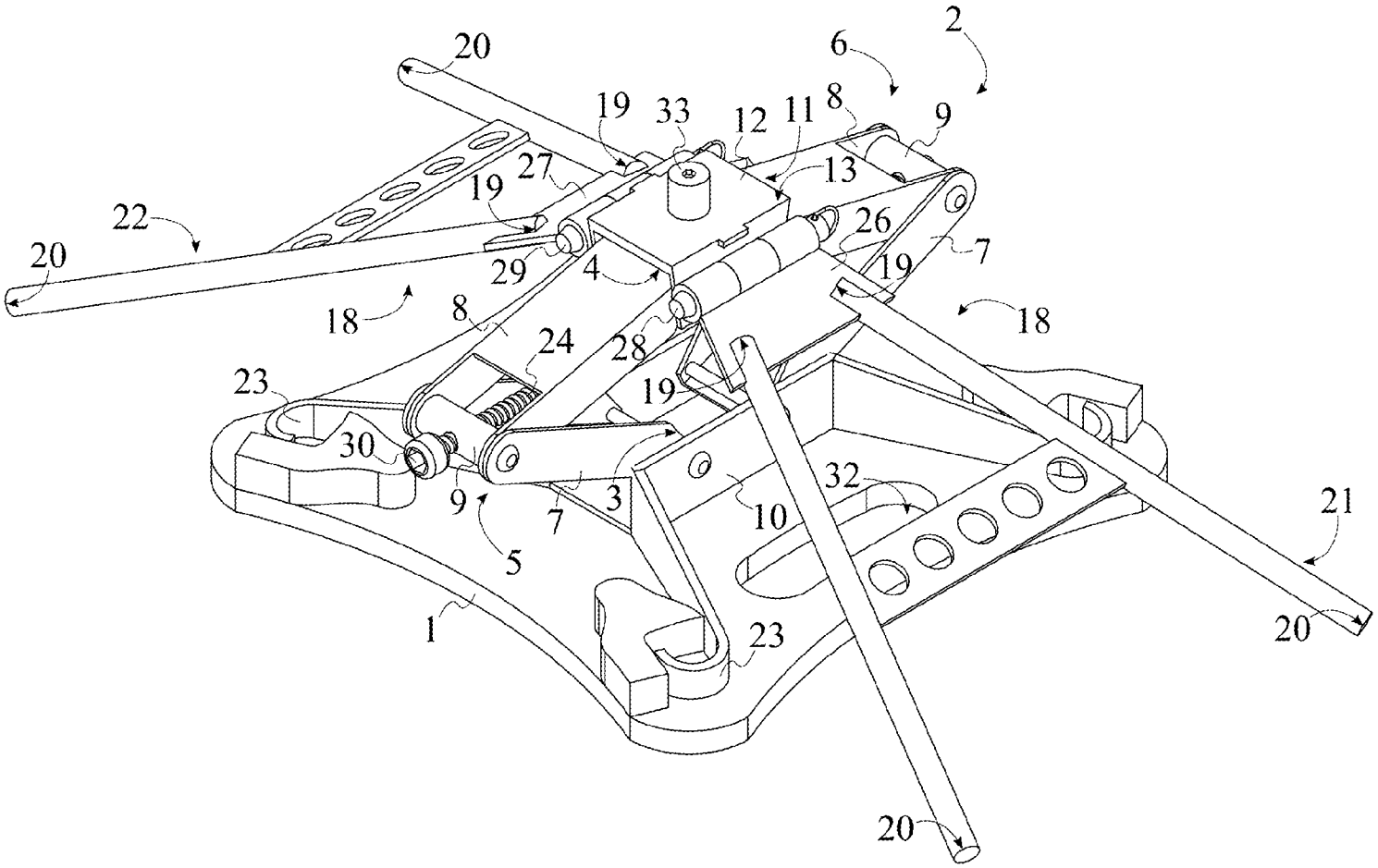
FIG. 5 is a perspective view of the present invention in a lowered configuration.
Figure 6:
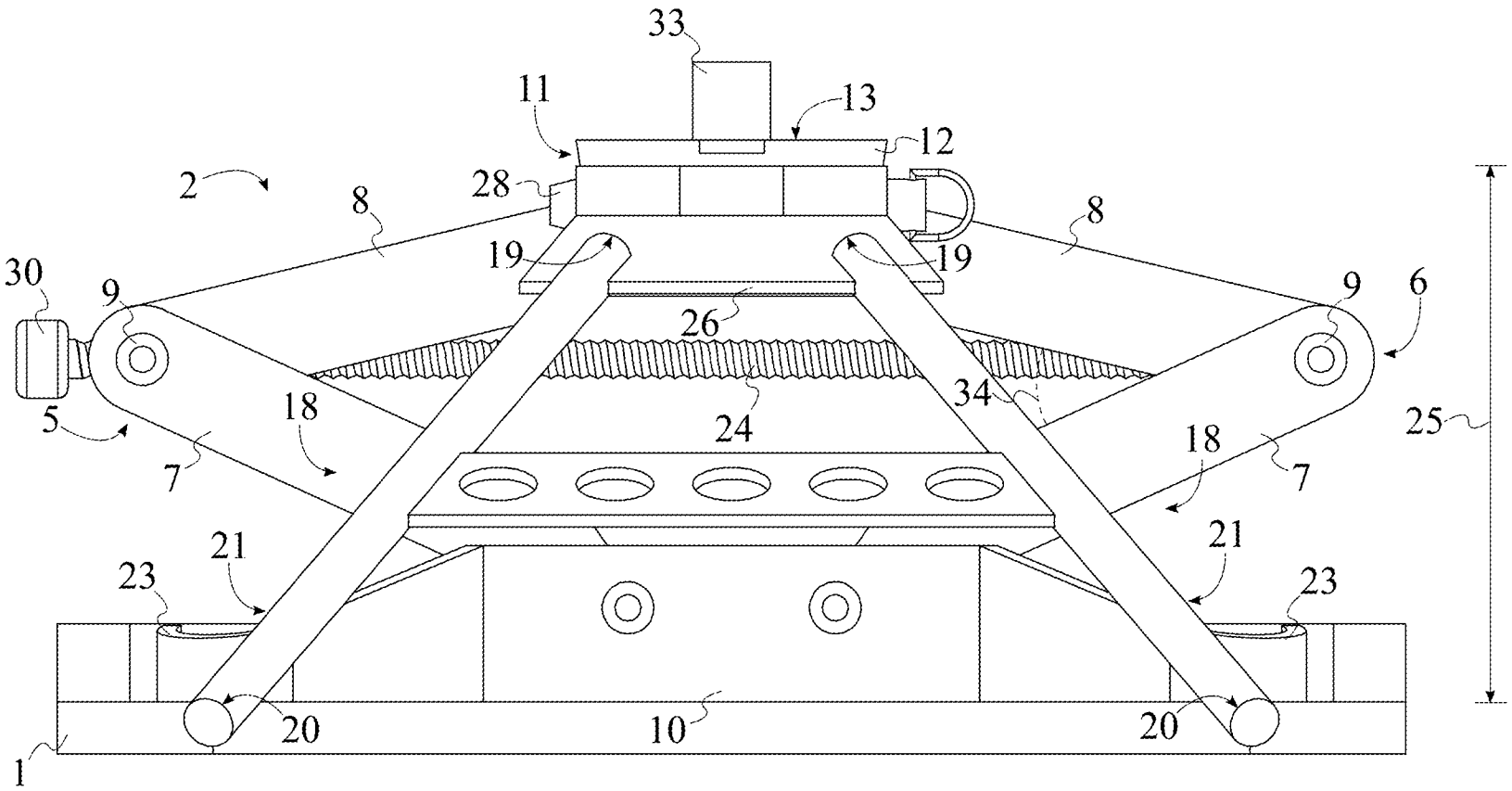
FIG. 6 is a front view of the present invention in the lowered configuration.

The scissor lift assembly 2, the plurality of support struts 18, and the plurality of strut braces 23 are shown in a lowered configuration in FIG. 5 and FIG. 7. The present invention is not in use or is in the process of elevating or lowering a vehicle when in the lowered configuration. The lower arm 7 and the upper arm 8 are oriented at an acute angle 34 to each other. As a result, the adjustable distance 25 is such that the mounting head 11 is positioned relatively close to the planar base 1. In the lowered configuration, the plurality of support struts 18 is positioned external to the plurality of strut braces 23. As a result, the plurality of support struts 18 does not stabilize the present invention while the present invention is in the lowered configuration.

The scissor lift assembly 2, the plurality of support struts 18, and the plurality of strut braces 23 are shown in an elevated configuration in FIGS. 1-3. When the present invention is in the elevated configuration, the present invention has elevated and stabilized a vehicle. The lower arm 7 and the upper arm 8 are oriented at an obtuse angle 35 to each other. As a result, the adjustable distance 25 is such that the mounting head 11 and by extension, the bottom of the vehicle, are significantly offset from the planar base 1. The plurality of support struts 18 is engaged into the plurality of strut braces 23 as well. The plurality of support struts 18 is thus able to provide stability to the present invention and the vehicle as the plurality of support struts 18 is fixed within the plurality of strut braces 23.

In addition to the three aforementioned examples, the design of the components of present invention may further vary in order to accommodate various additional types of engineered jacking points on vehicles.

The present invention is utilized by inserting the present invention underneath a vehicle jacking point while in the lowered configuration. The mounting head 11 is placed into contact with the jacking point. The threaded spindle 24 is then turned by applying a rotational force to the threaded spindle 24. This may be done by connecting a power tool to the input socket 30 or by turning the leveraging handle 31. As the threaded spindle 24 is rotated, the scissor lift assembly 2 is expanded in order to elevate the mounting head 11, elevating the vehicle. After the present invention is in the elevated configuration and the vehicle has reached a sufficient elevation, the lower end 20 of each of the plurality of support struts 18 is automatically moved and engaged into the plurality of strut braces 23 due to the hinged connection between the plurality of support struts 18 and the mounting head 11. Once the plurality of support struts 18 is engaged into the plurality of strut braces 23, the vehicle is elevated and the present invention is stabilized along with the vehicle as the mounting head 11 is unable to move due to the plurality of support struts 18 and the plurality of strut braces 23. There is no need for the user to venture underneath the vehicle while the vehicle is unstable in order to stabilize the present invention. The user is then able to perform work underneath the vehicle as needed. After work is completed, the first pair of support struts 21 and the second pair of support struts 22 are removed from the mounting head 11 by removing the first quick-release pin 28 and the second quick-release pin 29. The threaded spindle 24 is rotated in the opposite direction in order to lower the mounting head 11 and the vehicle. After the vehicle has been lowered, the present invention may be removed from underneath the vehicle.

Although the present invention has been explained in relation to its preferred embodiment, it is understood that many other possible modifications and variations can be made without departing from the spirit and scope of the present invention as hereinafter claimed.

What is claimed is:

1. A stabilized jack assembly comprises:

a planar base;

a mounting bracket;

a scissor lift assembly;

a mounting head;

a plurality of support struts;

a plurality of strut braces;

a threaded spindle;

the mounting bracket being centrally fixed on the planar base;

a first end of the scissor lift assembly being hingedly connected to the mounting bracket;

the mounting head being hingedly connected to a second end of the scissor lift assembly;

the mounting head being offset from the planar base by an adjustable distance;

an upper end of each of the plurality of support struts being hingedly and removably connected to the mounting head;

the plurality of strut braces being distributed about the planar base;

a lower end of each of the plurality of support struts being removably engaged into a corresponding brace from the plurality of strut braces; and the threaded spindle being axially engaged through the scissor lift assembly.

2. The stabilized jack assembly as claimed in claim 1 further comprises:

the scissor lift assembly further comprises a first pair of arms and a second pair of arms;

the first pair of arms and the second pair of arms each comprise a lower arm, an upper arm, and a joint;

the first pair of arms and the second pair of arms being positioned adjacent to each other on the mounting bracket;

the lower arm being hingedly connected to the mounting bracket;

the upper arm being hingedly connected to the lower arm by the joint, opposite to the mounting bracket;

the mounting head being hingedly connected to the upper arm, opposite to the lower arm; and the threaded spindle being axially engaged through the joint of the first pair of arms and the joint of the second pair of arms.

3. The stabilized jack assembly as claimed in claim 1 further comprises:

a first mounting plate;

a second mounting plate;

the plurality of support struts further comprises a first pair of support struts and a second pair of support struts;

the first mounting plate being connected to the upper end of the first pair of support struts;

the first pair of support struts being hingedly connected to the mounting head by the first mounting plate;

the second mounting plate being connected to the upper end of the second pair of support struts; and the second pair of support struts being hingedly connected to the mounting head by the second mounting plate, opposite to the first pair of support struts.

4. The stabilized jack assembly as claimed in claim 3 further comprises:

a first quick-release pin;

a second quick-release pin;

the first quick-release pin being removably engaged to the mounting head and the first mounting plate;

the first mounting plate being hingedly connected to the mounting head by the first quick-release pin;

the second quick-release pin being removably engaged to the mounting head and the second mounting plate; and the second mounting plate being hingedly connected to the mounting head by the second quick-release pin.

5. The stabilized jack assembly as claimed in claim 1 further comprises:

an input socket; and the input socket being terminally connected to the threaded spindle.

6. The stabilized jack assembly as claimed in claim 1 further comprises:

a leveraging handle; and the leveraging handle being terminally connected to the threaded spindle.

7. The stabilized jack assembly as claimed in claim 1 further comprises:

at least one carrying slot; and the at least one carrying slot traversing normally through the planar base.

8. The stabilized jack assembly as claimed in claim 1 further comprises:

a mounting pin;

the mounting head comprises a base plate and a pin hole;

the pin hole traversing normally through the base plate; and the mounting pin being engaged into the pin hole.

9. The stabilized jack assembly as claimed in claim 1 further comprises:

the mounting head comprises a base plate, a first retaining lip, and a second retaining lip;

the first retaining lip and the second retaining lip being connected across an upper surface of the base plate; and the first retaining lip and the second retaining lip being offset from and oriented parallel to each other.

10. The stabilized jack assembly as claimed in claim 1 further comprises:

the mounting head comprises a base plate, a first V-shaped plate, and a second V-shaped plate;

the first V-shaped plate and the second V-shaped plate being connected normal to an upper surface of the base plate; and the first V-shaped plate and the second V-shaped plate being offset from and oriented parallel to each other.

11. The stabilized jack assembly as claimed in claim 1 further comprises:

wherein the scissor lift assembly, the plurality of support struts, and the plurality of strut braces are in a lowered configuration;

the scissor lift assembly further comprises a first pair of arms and a second pair of arms;

the first pair of arms and the second pair of arms each comprise a lower arm and an upper arm;

the lower arm and the upper arm being oriented at an acute angle to each other; and the plurality of support struts being positioned external to the plurality of strut braces.

12. The stabilized jack assembly as claimed in claim 1 further comprises:

wherein the scissor lift assembly, the plurality of support struts, and the plurality of strut braces are in an elevated configuration;

the scissor lift assembly further comprises a first pair of arms and a second pair of arms;

the first pair of arms and the second pair of arms each comprise a lower arm and an upper arm;

the lower arm and the upper arm being oriented at an obtuse angle to each other; and the plurality of support struts being engaged into the plurality of strut braces.

* * * * *